US009804620B2

(12) United States Patent
Rogledi et al.

(10) Patent No.: US 9,804,620 B2
(45) Date of Patent: Oct. 31, 2017

(54) REGULATOR CIRCUIT, METHOD, AND CORRESPONDING POWER SUPPLY SYSTEM

(71) Applicant: STMicroelectronics S.r.l., Agrate Brianza (IT)

(72) Inventors: Nicola Rogledi, Pavia (IT); Paolo Vilmercati, Voghera (IT)

(73) Assignee: STMicroelectronics S.r.l., Agrate Brianza (MB) (IT)

( * ) Notice: Subject to any disclaimer, the term of this patent is extended or adjusted under 35 U.S.C. 154(b) by 0 days.

(21) Appl. No.: 15/212,204

(22) Filed: Jul. 16, 2016

(65) Prior Publication Data

US 2017/0060156 A1 Mar. 2, 2017

(30) Foreign Application Priority Data

Sep. 1, 2015 (IT) ..... 102015000047726

(51) Int. Cl.

| | |
|---|---|
| ***H02M 1/36*** | (2007.01) |
| ***G05F 1/46*** | (2006.01) |
| ***G05F 1/56*** | (2006.01) |
| ***G05F 1/575*** | (2006.01) |

(52) U.S. Cl.

CPC ..... *G05F 1/575* (2013.01); *G05F 1/46* (2013.01)

(58) Field of Classification Search

CPC .. H02M 1/36; G05F 1/468; G05F 3/26; G05F 1/461; G05F 1/56; G05F 1/565; G05F 1/575

See application file for complete search history.

(56) References Cited

U.S. PATENT DOCUMENTS

| | | | | |
|---|---|---|---|---|
| 8,129,965 | B2 * | 3/2012 | Kao | G05F 1/56 323/273 |
| 9,214,852 | B2 * | 12/2015 | Dong | H02M 1/36 |
| 2007/0120544 | A1 | 5/2007 | Ritter | |
| 2010/0301827 | A1 | 12/2010 | Chen et al. | |
| 2011/0181262 | A1 | 7/2011 | Deguchi | |
| 2014/0145698 | A1 | 5/2014 | Saito et al. | |

FOREIGN PATENT DOCUMENTS

WO 2012148977 A1 11/2012

* cited by examiner

*Primary Examiner* — Gary L Laxton

(74) *Attorney, Agent, or Firm* — Slater Matsil, LLP

(57) ABSTRACT

A track regulator circuit includes an input terminal for receiving an input signal, an output stage with an output terminal for applying an output signal to a load, an error amplifier coupled to the input terminal, and a feedback resistor between the output terminal and the error amplifier for transferring to the error amplifier a feedback signal indicative of the output signal. The error amplifier is configured for driving the output stage as a function of the difference between the input signal and the output signal so that the output signal tracks the input signal. The circuit includes a current generator coupled to the feedback resistor for injecting into the feedback resistor a soft-start current to unbalance the error amplifier, with the intensity of the soft-start current gradually ramping down to zero.

23 Claims, 2 Drawing Sheets

REGULATOR CIRCUIT, METHOD, AND CORRESPONDING POWER SUPPLY SYSTEM

This application claims priority to Italian Patent Application No. 102015000047726, filed on Sep. 1, 2015, which application is hereby incorporated herein by reference.

TECHNICAL FIELD

The description relates to track regulators. One or more embodiments may apply to power supply systems including separate voltage supplies at, e.g., the same voltage.

BACKGROUND

Track regulators are may be used, e.g., in power supply systems including separate voltage supplies at, e.g., the same voltage.

For instance, separate voltages may facilitate decoupling a main supply (as used, e.g., by a microcontroller) and ancillary supplies (e.g., sensor supplies) that may be fed outside the controller board and may be exposed to short circuits.

A track regulator is a kind of regulator whose voltage follows (or "tracks") the voltage of another regulator to provide a separate voltage supply at, e.g., a same voltage thus acting, e.g., as a power buffer.

A soft-start function during track regulator start-up may be beneficial in order to limit inrush current and overshoot voltage at output. A voltage supply overshoot may cause, e.g., sensor/load damages. Also, an uncontrolled voltage slope may cause inrush current and destroy some parts of load.

Certain factors may affect implementing such a soft-start function for a track regulator.

For instance, the error amplifier in the track regulator may use a N-channel input pair and the input range of a N-channel input amplifier cannot be (too) close to the ground rail.

Also, the feedback loop of a track regulator with an N-channel input pair may be effective only when the output voltage is higher than a certain voltage (e.g., one $V_{GS}$ voltage).

Implementing a soft-start function in a track regulator working in a 5V range may thus be faced with various critical aspects.

Soft-start may be implemented via a digital-to-analog (D/A or D2A) converter that controls the input reference voltage used by regulator. Such a solution may be expensive, e.g., in terms of area, this being particularly the case when soft-start functions are implemented for many track regulators.

SUMMARY

Embodiments of the invention specify improved, cost-effective soft-start solutions for track regulators able to avoid inrush current and overshoot voltage during at start-up.

Further embodiments relate to a corresponding method as well as a corresponding power supply system.

BRIEF DESCRIPTION OF THE DRAWINGS

One or more embodiments will now be described, by way of example only, by referring to the enclosed figures, wherein.

DETAILED DESCRIPTION OF ILLUSTRATIVE EMBODIMENTS

In the ensuing description one or more specific details are illustrated, aimed at providing an in-depth understanding of examples of embodiments. The embodiments may be obtained without one or more of the specific details, or with other methods, components, materials, etc. In other cases, known structures, materials, or operations are not illustrated or described in detail so that certain aspects of embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in one or more points of the present description do not necessarily refer to one and the same embodiment. Moreover, particular conformations, structures, or characteristics may be combined in any adequate way in one or more embodiments.

The references used herein are provided merely for convenience and hence do not define the scope of protection or the scope of the embodiments.

Figure 1:
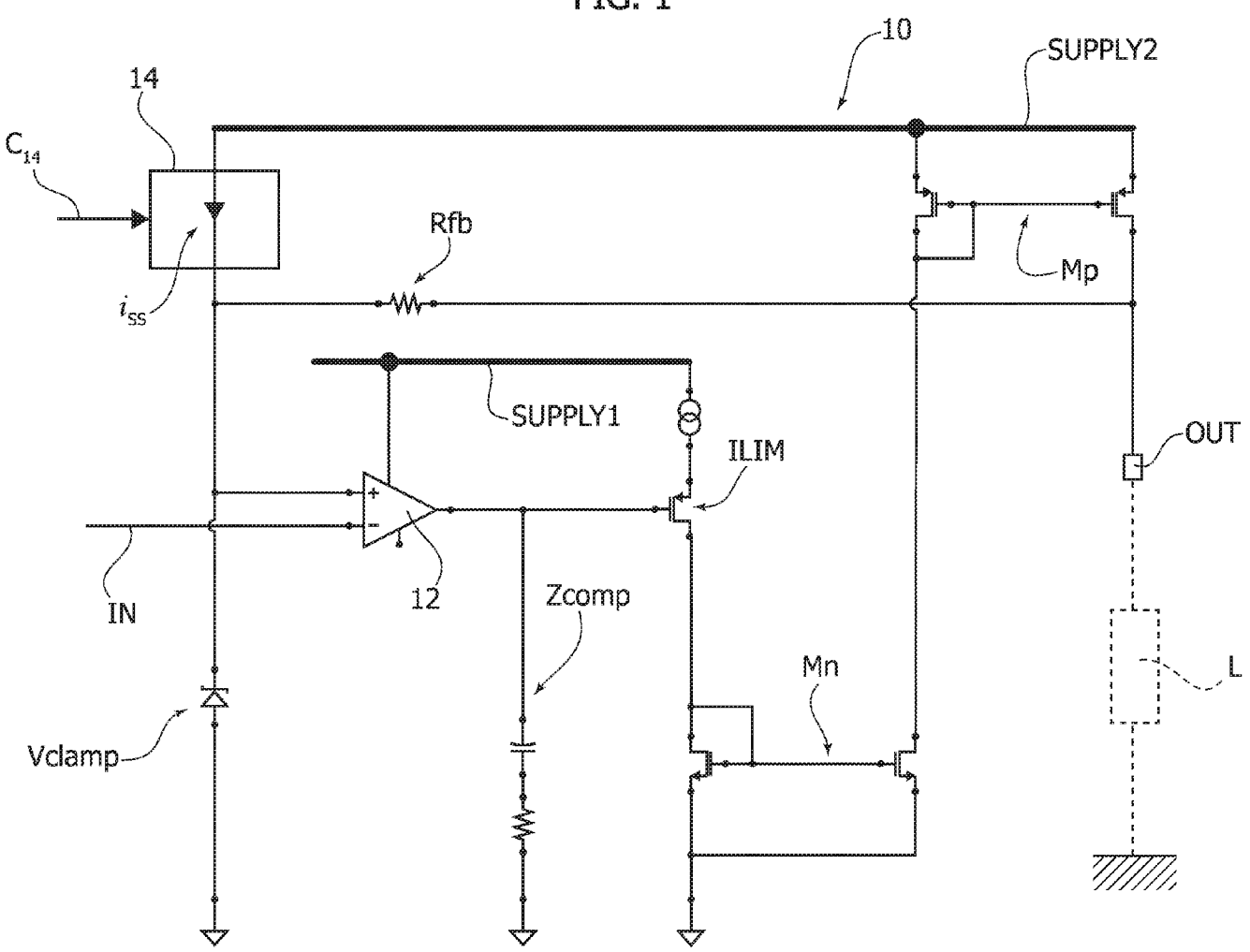
FIG. 1 is a schematic block diagram of exemplary embodiments.

FIG. 1 is a schematic block diagram of an exemplary embodiment of a track regulator 10. Such a regulator 10 may be used to generate at an output terminal OUT an output voltage $V_{LOAD}$ that follows (e.g., is equal to) a reference voltage $V_{IN}$ supplied at an input terminal IN, thus acting as a sort of buffer decoupling a load L (shown in dashed lines, as this may not be a part of embodiments) from the reference voltage $V_{IN}$ As indicated, such a track regulators may be used, e.g., in a power supply system including separate voltage supplies at, e.g., the same voltage, such as a main supply line (as used e.g., by a microcontroller) and one or more ancillary supply lines (e.g., sensor supplies) which may be fed outside the controller board and may be exposed to short circuits.

In one or more embodiments, the track regulator 10 may include a regulator loop built around an error amplifier 12 that receives at its inverting input the reference voltage $V_{IN}$ supplied at the input terminal IN.

In one or more embodiments, the error amplifier 12 may be energized via a first supply line SUPPLY1.

In one or more embodiments, the regulator loop may include a feedback resistor Rfb set between the output terminal OUT (that is the output voltage $V_{LOAD}$) and the non-inverting input of the error amplifier 12.

In one or more embodiments, the regulator loop may also include a current limitation module (e.g., MOSFET-based) ILIM, plus current mirror stages Mn, Mp (this latter energized via a second supply line SUPPLY2) as well as a (e.g., RC) compensation network Zcomp.

In one or more embodiments an input clamp Vclamp (e.g., a Zener diode) may be provided, e.g., coupled to the non-inverting input to the error amplifier 12 in order to limit the input voltage of the error amplifier 12 for protection purposes.

The structure and operation of the elements just considered may be of a conventional type, thus making it unnecessary to provide a more detailed description herein.

Those of skill in the art will otherwise appreciate that one more embodiments as described in the following may apply to different track regulator topologies operating according to the same principles exemplified in the block diagram of FIG. 1. For example, an embodiment track regulator circuit includes an input terminal IN for receiving an input signal $V_{IN}$ and an output stage (here Mn, Mp) with an output terminal OUT for applying an output signal $V_{LOAD}$ to a load L. An error amplifier 12 is coupled to the input terminal IN. A feedback resistor Rfb between the output terminal OUT and the error amplifier 12 can be used for transferring a feedback signal indicative of the output signal $V_{LOAD}$ to the error amplifier 12. The error amplifier 12 is configured for driving the output stage Mn, Mp as a function of the difference (as sensed, e.g., between the inverting and the non-inverting inputs of the error amplifier 12) between the input signal $V_{IN}$ and the output signal $V_{LOAD}$ so that the output signal $V_{LOAD}$ tracks (that is, follows) the input signal $V_{IN}$.

One or more embodiments may in include a soft-start function that may be implemented by means of the feedback resistor Rfb in combination with a variable (e.g., linear) current generator 14.

In one or more embodiments, the current generator 14 can be energized via the supply line SUPPLY2 and be coupled to the feedback resistor Rfb in correspondence with the non-inverting (feedback) input of the error amplifier 12.

Figure 2:
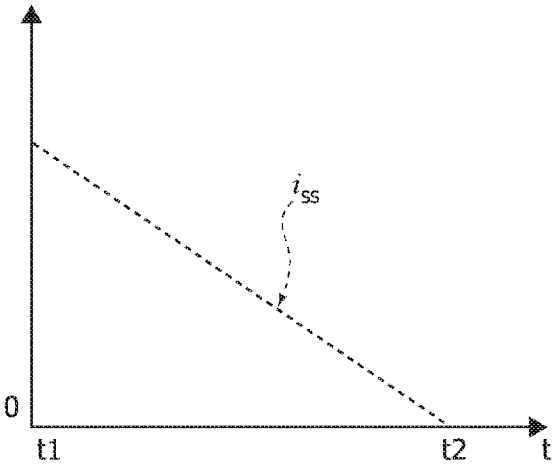
FIGS. 2 and 3 are time diagrams showing the possible behavior of certain signals in one or more embodiments.

In one or more embodiments, the current generator 14 can generate a current $i_{SS}$ in the form of a (e.g., linear) downward current ramp as schematically represented by a dashed line in FIG. 2.

During normal, steady-state operation the current generator (which may be controlled over a control line $C_{14}$, e.g., by a microcontroller, not visible in the figure) is off.

No current will flow through the feedback resistor Rfb with the output voltage $V_{LOAD}$ on the terminal OUT tracking (e.g., being the same as) the voltage $V_{IN}$ supplied at the input terminal IN: the regulator 10 will thus be operating with the feedback loop forcing the voltage $V_{LOAD}$ on the load L to be equal to $V_{IN}$. The current limitation function ILIM, in series with the regulator loop may control the load current to a limited value.

During a startup phase (times t1 to t2 in FIGS. 2 and 3) the current generator 14 is activated (e.g., via $C_{14}$) at time t1 to generate the highest value of the current $I_{SS}$.

This will result in the current amplifier 12 becoming unbalanced due to the voltage drop across the feedback resistor Rfb with the non-inverting input the current amplifier 12 reaching a (much) higher level with respect to $V_{IN}$, with the voltage $V_{LOAD}$ on the load L practically forced to zero.

As the startup phase progresses, the current generator 14 may be controlled (e.g., via $C_{14}$) so that the current $i_{SS}$ is gradually ramped down to zero (e.g., linearly: see FIG. 2).

Figure 3:
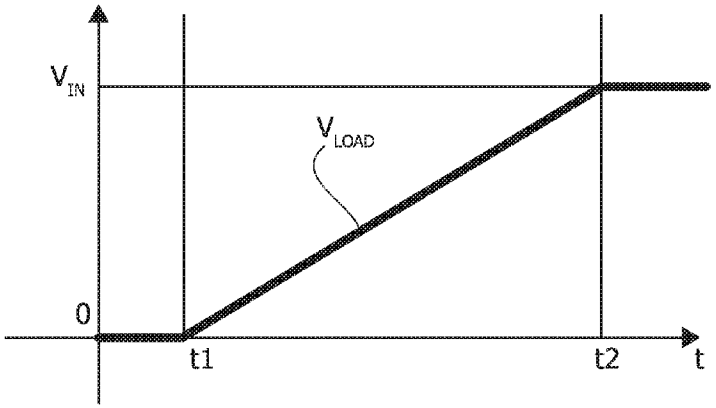

This will in turn result in the voltage $V_{LOAD}$ ramping up, e.g., as:

$$V_{LOAD}=V_{IN}-i_{SS}*Rfb$$

thus achieving the soft-start operation schematically represented in FIG. 3.

Once $i_{SS}$ reaches zero (time t2) the voltage across the feedback resistor Rfb is zero and normal operation is achieved.

Without prejudice to the underlying principles, the details and embodiments may vary, even significantly, with respect to what has been described by way of example only without departing from the extent of protection.

The extent of protection is defined by the annexed claims.

What is claimed is:

1. A regulator circuit comprising:

an input terminal configured to receive an input signal;

an output stage with an output terminal configured to apply an output signal to a load;

an error amplifier having a first input coupled to the input terminal, a second input, and an output;

a feedback resistor coupled between the output terminal and the second input of the error amplifier for transferring a feedback signal indicative of the output signal to the error amplifier, wherein the error amplifier is configured to drive the output stage as a function of a difference between the input signal and the output signal; and a current generator coupled to the feedback resistor and configured to generate a soft-start current to unbalance the error amplifier, an intensity of the soft-start current ramping down to zero.

2. The regulator circuit of claim 1, wherein the error amplifier is configured to drive the output stage as a function of the difference between the input signal and the output signal so that the output signal tracks the input signal.

3. The regulator circuit of claim 1, wherein the current generator is configured to ramp down the intensity of the soft-start current as a linear ramp.

4. The regulator circuit of claim 1, wherein the error amplifier comprises an inverting input and a non-inverting input with the input terminal coupled to the inverting input and the feedback resistor coupled to the non-inverting input.

5. The regulator circuit of claim 1, further comprising a current limiting circuit configured to control a current applied to the load via the output terminal to a limited value.

6. The regulator circuit of claim 1, wherein the output stage comprises a current mirror stage driven by the error amplifier.

7. The regulator circuit of claim 1, further comprising a compensation network coupled to the output of the error amplifier.

8. The regulator circuit of claim 7, wherein the compensation network comprises an RC compensation network.

9. The regulator circuit of claim 1, further comprising an input clamp component coupled to input of the error amplifier for limiting a voltage input to the error amplifier.

10. The regulator circuit of claim 9, wherein the input clamp component comprises a Zener diode.

11. A power supply system including a regulator circuit according to claim 1.

12. The power supply system of claim 11, further comprising a main supply line and an ancillary supply line, with the regulator circuit having the input terminal and the output terminal coupled to the one and the other of the main supply line and the ancillary supply line.

13. A system comprising:

a main supply line configured to carry a supply voltage having a first voltage value;

an ancillary supply line configured to carry a supply voltage having the first voltage value;

a reference supply line;

an input terminal coupled to the main supply line;

an output stage with an output terminal, the output stage coupled between the main supply line and the reference supply line;

an error amplifier having a supply terminal coupled to the ancillary supply line, a first input coupled to the input terminal, a second input, and an output coupled to drive the output stage;

a feedback resistor coupled between the output terminal and the second input of the error amplifier for transferring to a feedback signal indicative of an output signal at the output terminal to the error amplifier; and a current generator coupled to the feedback resistor and also coupled between the input terminal and the main supply line, the current generator configured to generate a soft-start current at a node between the second input of the error amplifier and the feedback resistor, an intensity of the soft-start current ramping down to zero.

14. The system of claim 13, wherein the feedback resistor is configured to transfer a feedback signal indicative of the output signal to the error amplifier; and wherein the error amplifier is configured to drive the output stage as a function of a difference between an input signal provided to the input terminal and an output signal generated at the output terminal so that the output signal tracks the input signal.

15. The system of claim 13, wherein the first input of the error amplifier is an inverting input and the second input of the error amplifier is a non-inverting input.

16. The system of claim 13, wherein the output stage comprises a current mirror stage driven by the error amplifier.

17. The system of claim 13, further comprising a load coupled to the output terminal.

18. The system of claim 13, further comprising an RC compensation network coupled to the output of the error amplifier.

19. The system of claim 13, further comprising an input clamp component coupled to the second input of the error amplifier.

20. A method of providing soft-start operation in a track regulator circuit, the method comprising:

receiving an input signal at an input terminal of the track regulator circuit;

applying an output signal to a load via an output terminal of an output stage of the track regulator circuit;

transferring a feedback signal indicative of the output signal to an error amplifier via a feedback resistor, the error amplifier driving the output stage as a function of a difference between the input signal and the output signal so that the output signal tracks the input signal; and generating a soft-start current to flow to unbalance the error amplifier, the soft-start current having an intensity that ramps down to zero.

21. The method of claim 20, wherein the soft-start current has an intensity that ramps down to zero linearly.

22. The method of claim 20, further comprising controlling a current applied to the load via the output terminal to a limited value.

23. The method of claim 20, further comprising limiting a voltage input to the error amplifier.

* * * * *